US009465394B2

(12) United States Patent
Wang

(10) Patent No.: US 9,465,394 B2
(45) Date of Patent: Oct. 11, 2016

(54) LOW-DROP REGULATOR APPARATUS AND BUFFER STAGE CIRCUIT HAVING HIGHER VOLTAGE TRANSITION RATE

(71) Applicant: Silicon Motion Inc., Hsinchu County (TW)

(72) Inventor: Chiao-Hsing Wang, Taoyuan County (TW)

(73) Assignee: Silicon Motion Inc., Hsinchu County (TW)

( * ) Notice: Subject to any disclaimer, the term of this patent is extended or adjusted under 35 U.S.C. 154(b) by 98 days.

(21) Appl. No.: 14/210,307

(22) Filed: Mar. 13, 2014

(65) Prior Publication Data

US 2015/0097540 A1 Apr. 9, 2015

(30) Foreign Application Priority Data

Oct. 4, 2013 (TW) ..... 102136060 A

(51) Int. Cl.
*G05F 1/00* (2006.01)
*G05F 1/56* (2006.01)
*G05F 1/575* (2006.01)

(52) U.S. Cl.
CPC ..... *G05F 1/56* (2013.01); *G05F 1/575* (2013.01)

(58) Field of Classification Search
CPC ..... G05F 1/56; G05F 1/575; G05F 3/262; H02M 3/157; H02M 2001/0045
USPC ..... 323/271, 273, 277, 282–288, 312, 315, 323/316, 267, 265; 327/301, 530, 534, 535
See application file for complete search history.

(56) References Cited

U.S. PATENT DOCUMENTS 6,300,749 B1 * 10/2001 Castelli ..... G05F 1/575 323/273
6,518,737 B1 * 2/2003 Stanescu ..... G05F 1/575 323/280
6,703,815 B2 * 3/2004 Biagi ..... G05F 1/575 323/275
6,989,659 B2 * 1/2006 Menegoli ..... G05F 3/262 323/274
7,821,242 B2 * 10/2010 Takagi ..... 323/275

(Continued)

FOREIGN PATENT DOCUMENTS

CN 102778911 * 11/2012
CN 102778911 A 11/2012

(Continued)

*Primary Examiner* — Rajnikant Patel
(74) *Attorney, Agent, or Firm* — Winston Hsu; Scott Margo

(57) ABSTRACT

A low-drop regulator (LDO) apparatus includes an operational amplifier, a buffer stage circuit, and a power transistor. The operational amplifier is used for receiving a reference voltage and a feedback voltage to generate a first voltage. The buffer stage circuit is coupled to the power transistor and the operational amplifier and used for buffering the first voltage to generate a second voltage. The power transistor is coupled to the buffer stage circuit and used for generating an output voltage according to the second voltage wherein the output voltage is proportional to the feedback voltage. In addition, the buffer stage circuit is arranged to determine whether to mirror and generate a mirrored current according to the first voltage and to generate the second voltage for providing the second voltage to the power transistor to control on/off state of the power transistor when the mirrored current is generated.

8 Claims, 5 Drawing Sheets

(56) References Cited

U.S. PATENT DOCUMENTS

| | | | | |
|---|---|---|---|---|
| 7,834,600 | B2 * | 11/2010 | Bassett et al. | 323/265 |
| 8,080,983 | B2 * | 12/2011 | Lourens | G05F 1/575 323/275 |
| 8,305,066 | B2 * | 11/2012 | Lin | G05F 1/575 323/285 |
| 2011/0156674 | A1 | 6/2011 | Lin | |
| 2013/0257401 | A1 | 10/2013 | Fort | |

FOREIGN PATENT DOCUMENTS

| | | | |
|---|---|---|---|
| EP | 1 806 640 | B1 | 10/2010 |
| TW | 201135390 | | 10/2011 |
| WO | 2007009484 | A1 | 1/2007 |

* cited by examiner

LOW-DROP REGULATOR APPARATUS AND BUFFER STAGE CIRCUIT HAVING HIGHER VOLTAGE TRANSITION RATE

BACKGROUND OF THE INVENTION

1. Field of the Invention

The present invention relates to a low-drop (LDO) regulator scheme, and more particularly to an LDO regulator apparatus and a corresponding buffer stage circuit.

2. Description of the Prior Art

Generally speaking, since the size of a power transistor in a conventional LDO regulator circuit is very large, the capacitance value at the gate terminal of the conventional power transistor is also very large. When a loading current flowing through the conventional power transistor changes from a light loading current to a heavy loading current or from the heavy loading current to the light loading current, the voltage level at the gate terminal of the conventional power transistor may not be timely changed due to the large capacitance value. This results in an abrupt voltage change in an output voltage of the conventional LDO regulator circuit. Please refer to FIG. 5, which is a diagram illustrating waveforms of the level V2 at the gate terminal of the conventional power transistor, the output voltage VOUT, and the loading current I. As shown in FIG. 5, when the loading current I changes from a light loading current to a heavy loading current, practically it needs to wait a time period t1 to reduce the level V2 at the gate terminal and cause the level V2 from a high level to reach a low level; the power transistor is a P-type transistor. The time period t1 would cause an abrupt voltage change ΔVUOT1 in the output voltage VOUT which is stable originally. Additionally, when the loading current I changes from the heavy loading current to the light loading current, practically it needs a time period t2 to raise the level V2 at the gate terminal and cause the level V2 from the low level to reach the high level. The time period t2 would cause an abrupt voltage change ΔVUOT2 in the output voltage VOUT which is stable originally. The abrupt voltage changes ΔVUOT1 and ΔVUOT2 result from the large size of the conventional power transistor and the over-low voltage transition rate. It is important to improve the over-low voltage transition rate of the power transistor in the conventional LDO regulator circuit.

SUMMARY OF THE INVENTION

Therefore one of the objectives of the present invention is to provide an LDO regulator apparatus and a corresponding buffer stage circuit, to solve the above-mentioned problems.

According to an embodiment of the present invention, an LDO regulator apparatus is disclosed. The LDO regulator apparatus comprises an operational amplifier, a buffer stage circuit, and a power transistor. The operational amplifier is utilized for receiving a reference voltage and a feedback voltage to generate a first voltage signal. The buffer stage circuit is coupled to the power transistor and utilized for buffering the first voltage signal to generate a second voltage signal. The power transistor is coupled to the buffer stage circuit and utilized for generating an output voltage according to the second voltage signal wherein the output voltage is proportional to the feedback voltage. The buffer stage circuit is arranged to decide whether to mirror and generate a mirrored current according the first voltage signal. Further, the buffer stage circuit is arranged to generate the second voltage signal according to the first voltage signal and provide the second voltage signal to the power transistor to control an on/off status of the power transistor.

Further, according to the embodiment of the present invention, a buffer stage circuit in the LDO regulator apparatus is disclosed. The buffer stage circuit is coupled between an operational amplifier and a power transistor. The buffer stage circuit comprises a first switch, a current mirror, and a second switch. The first switch is utilized for receiving a first voltage signal generated by the operational amplifier and deciding whether to enable an operation of the current mirror. The current mirror is coupled to the first switch and utilized for mirroring and generating a mirrored current according to the first voltage signal. The second switch is coupled to an output terminal of the current mirror and utilized for providing a second voltage signal to the power transistor to turnoff the power transistor when the mirrored current is not generated by the current mirror. When second switch is turned on, the current mirror is disabled, and the second switch is arranged to provide the second voltage signal for the power transistor to turn off the power transistor. When the second switch is turned off, the current mirror is enabled and arranged to mirror and generate the mirrored current according to the first voltage signal to generate a second voltage signal to turn on the power transistor.

According to the embodiments, the advantage of improving the over-low voltage transition rate at the gate terminal of a power transistor can be obtained by using a native transistor of the buffer stage circuit or by using the current mirror to generate a large current. Thus, the problems caused by the conventional LDO regulator circuit can be avoided.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
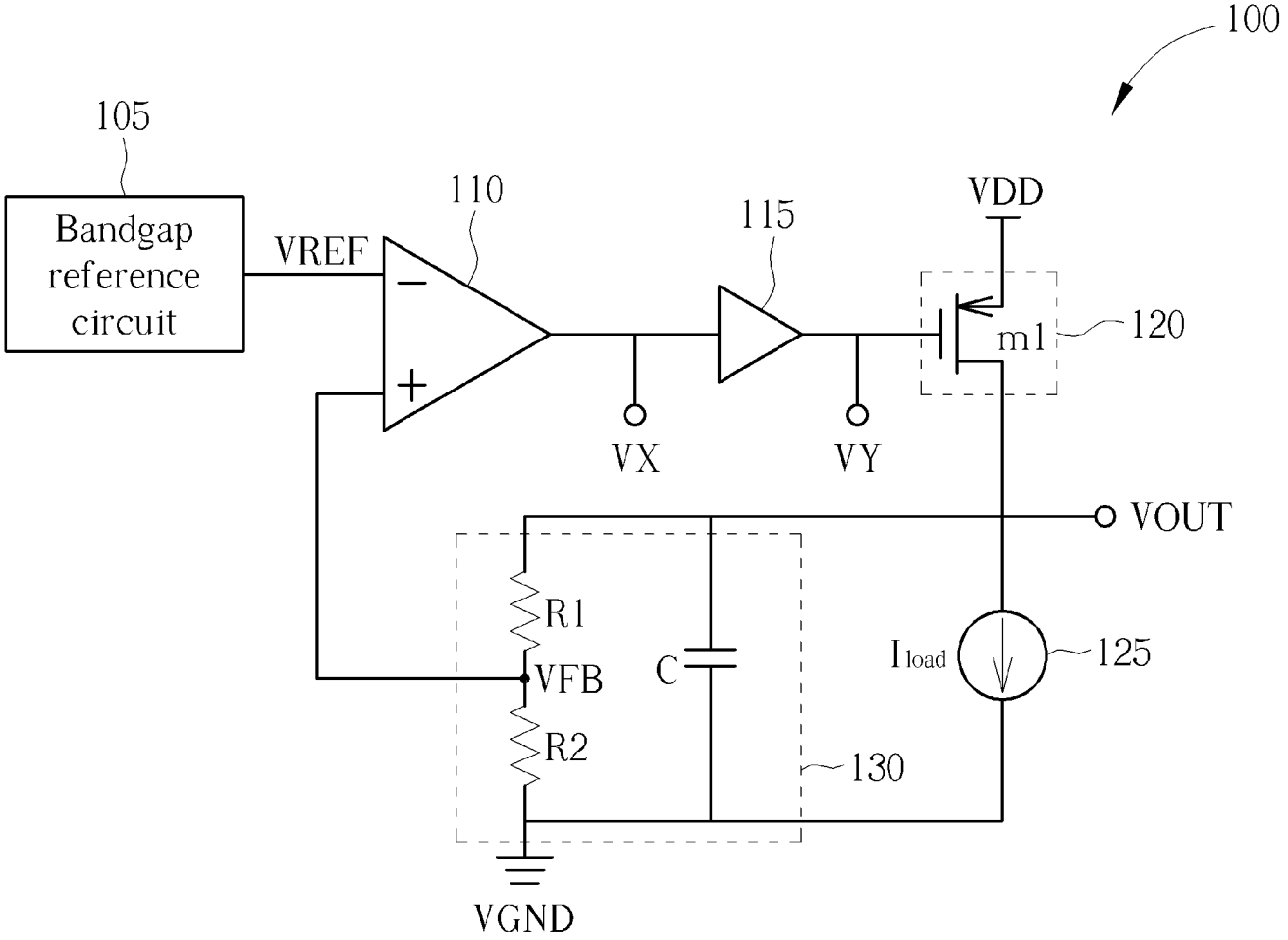
FIG. 1 is a circuit schematic diagram of a low-drop voltage regulator apparatus according to an embodiment of the present invention.

Please refer to FIG. 1. FIG. 1 is a circuit schematic diagram of a low-drop (LDO) voltage regulator apparatus 100 according to an embodiment of the present invention. The LDO voltage regulator apparatus 100 comprises an operational amplifier 110, a buffer stage circuit 115, a power transistor 120 (i.e. transistor m1), a bandgap reference circuit 105, a current source 125, and a feedback circuit 130. The bandgap reference circuit 105 is utilized for generating a reference voltage VREF. The inverting input terminal of the operational amplifier 110 is coupled to the bandgap reference circuit 105, and its non-inverting input terminal is coupled to a feedback voltage VFB. The output terminal of the operational amplifier 110 is coupled to the buffer stage circuit 115 of the next stage. The operational amplifier 110 is utilized for receiving the reference voltage VREF and the feedback voltage VFB and generating a first voltage signal VX according to the reference voltage VREF and the feedback voltage VFB. The input terminal of the buffer stage circuit 115 is coupled to the operational amplifier 110, and its output terminal is coupled to the gate control terminal of the power transistor 120. The buffer stage circuit 115 is utilized for buffering the first voltage signal VX to generate a second voltage signal VY. In this embodiment of the present invention, the power transistor 120 is implemented using a P-type transistor. The gate control terminal of the P-type transistor is coupled to the buffer stage circuit 115, and its source terminal is coupled to an operation voltage VDD. Its drain terminal is coupled to the current source 125. The power transistor 120 is utilized for generating an output voltage VOUT according to the second voltage signal VY. The feedback voltage VFB mentioned above is generated by dividing the output voltage VOUT via the feedback circuit 130. In other words, the level of the feedback voltage VFB is proportional to the level of the output voltage VOUT. In addition, the buffer stage circuit 115 is disposed between the operational amplifier 110 and power transistor 120, to raise the voltage transition rate for the level at the gate terminal of power transistor 120. This avoids that an abrupt change of voltage is introduced into the stable output voltage VOUT due to a lower transition rate of voltage at the gate terminal of power transistor 120. Accordingly, the buffer stage circuit 115 includes the function and operation for rapidly raising or rapidly cutting down the voltage level (i.e. second voltage signal VY) at the gate terminal of power transistor 120 when the loading current $I_{load}$ changes, and this makes that the whole LDO voltage regulator apparatus 100 includes a high enough voltage transition rate. For the operation of rapidly raising the level of second voltage signal VY, the buffer stage circuit 115 is arranged to rapidly raise the voltage level of the second voltage signal VY from the ground level VGND to a voltage level which is almost close to the operation voltage VDD by conducting a native transistor. In practice, since the threshold voltage of the native transistor is almost close to zero, the buffer stage circuit 115 equivalently raises the level of second voltage signal VY rapidly from the ground level VGND to the operation voltage VDD. Additionally, for the operation of rapidly cutting down the level of second voltage signal VY, the buffer stage circuit 115 mirrors and generates a large current by the current mirror to rapidly reduce the level of second voltage signal VY; the large current is K2 times more than a specific current unit. The large current is used to rapidly cut down the level of second voltage signal VY from the operation voltage VDD to the ground level VGND. Accordingly, for the operations mentioned above, the buffer stage circuit 115 is arranged to decide whether to mirror and generate a mirrored current according to the first voltage signal VX. When generating the mirrored current, the buffer stage circuit 115 generates and provides the second voltage signal VY for the power transistor 120 according to the mirrored current, to control the on/off status of the power transistor 120. In practice, an example of circuitry elements within the buffer stage circuit 115 is detailed in the following.

Figure 2:
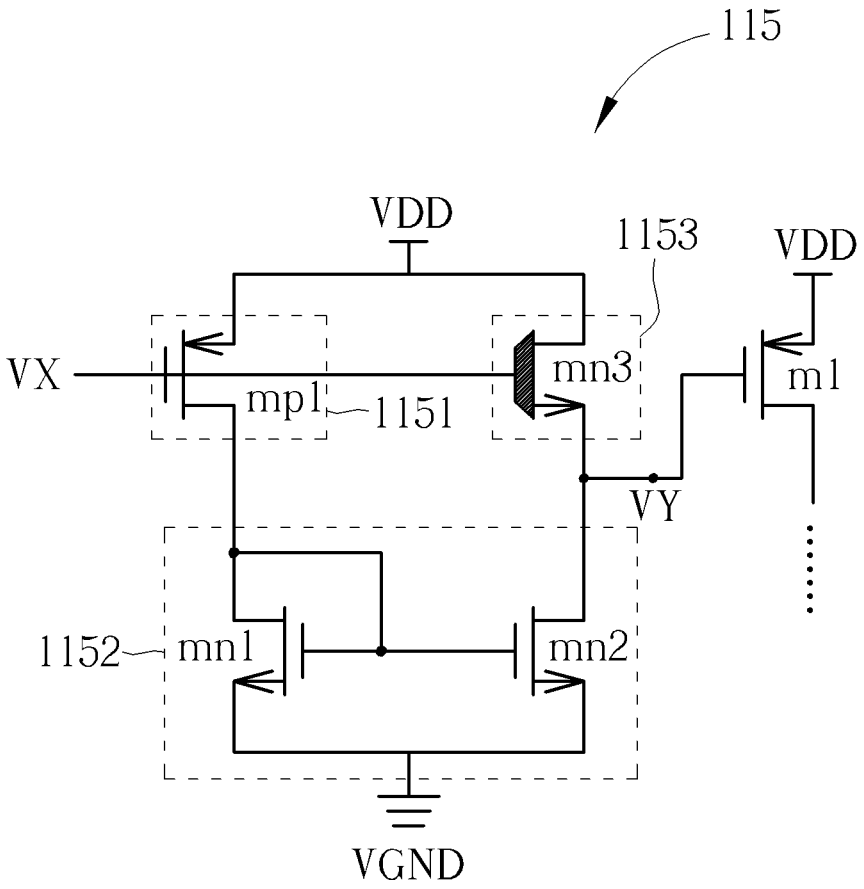
FIG. 2 is a circuit schematic diagram of the buffer stage circuit shown in FIG. 1.

Please refer to FIG. 2. FIG. 2 is a circuit schematic diagram of the buffer stage circuit 115 shown in FIG. 1. As shown in FIG. 2, the buffer stage circuit 115 comprises a first switch 1151, a current mirror 1152, and a second switch 1153. The first switch 1151 is implemented using the transistor mp1. The current mirror 1152 comprises two transistors mn1 and mn2. The second switch 1153 is implemented using the transistor mn3 that is a native transistor and includes a threshold voltage that is almost close to zero. By the threshold voltage almost close to zero, when turning off the power transistor 120 that is implemented using the P-type transistor in this embodiment, the operational amplifier 110 is arranged to output the first voltage signal VX to the buffer stage circuit 115 wherein the level of the first voltage signal VX is close the operation voltage VDD. When the first voltage signal VX is at a high level (i.e. the operation voltage VDD), the first switch 1151 is turned off, the current mirror 1152 is disabled, and the second switch 1153 is turned on. In this situation, the level of second voltage signal VY is raised to approximate to the level of operation voltage VDD because the threshold voltage of the native transistor is close to zero. The transistor mn3 within the second switch 1153 can be regarded as a source follower implemented using the N-type transistor and includes a high enough voltage transition rate. In addition, since the level of second voltage signal VY is close to the operation voltage VDD, the power transistor 120 in this situation is turned off immediately.

Additionally, when turning on the power transistor 120 that is implemented using the P-type transistor in this embodiment, the level of first voltage signal VX outputted by the operational amplifier 110 to the buffer stage circuit 115 is reduced rapidly. Since the level of first voltage signal VX in this situation is reduced down to a low level, the first switch 1151 is turned on, the current mirror 1152 is enabled, and the second switch 1153 is turned off. In this embodiment, the ratios of channel length/width of transistors mn1 and mn2 are designed with a relation of one to K2; K2 is an integer or a positive number which is greater than one. That is, assuming that the current amount of transistor mn1 (i.e. the current amount of transistor mp1 passing through the first switch 1151) is equal to one current amount, the current amount passing through the transistor mn2 is equal to K2 times more than one current amount. Since in this situation the second switch 1153 is off and disconnected, the current amount which is K2 times more than one current amount can be used to immediately reduce the level of second voltage signal VY down to the ground level VGND. This causes that the level at the gate terminal of power transistor 120 becomes the low level and thus the power transistor 120 is conducted. Because the mirrored current including the large current amount of K2 times is arranged to cut down the voltage value of the signal VY, this circuit configuration can obtain a high enough voltage transition rate.

Further, ratios of channel length/width of the transistor mp1 of first switch 1151 and the power transistor 120 can be designed with a relation of one to K1. Thus, identical or different amounts of current passing the transistors mp1, mn1, and mn2 are all varied with the amount of current passing through the power transistor 120. When the loading current passing through the power transistor 120 changes from a heavy loading current to a light loading current, all the amounts of current flowing through the transistors mp1, mn1, and mn2 become smaller consequently. Instead, when the loading current passing through the power transistor 120 changes from a light loading current to a heavy loading current, all the amounts of current flowing through the transistors mp1, mn1, and mn2 become larger consequently. By doing this, a higher power efficiency can be achieved.

Therefore, by the design of the native transistor mn3 of second switch 1153 and the design of current mirror 1152, this can make that the level of second voltage signal VY is rapidly changed with the transition of first voltage signal VX between the high level and low level. Consequently, the LDO voltage regulator apparatus 100 is able to achieve a higher rate for voltage level transition. When the loading current flowing through the power transistor 120 is changed, the buffer stage circuit 115 can be used to improve the low transition rate for the level at the gate terminal of a transistor and thus obtain an advantage of rapidly changing the level at the gate terminal. Accordingly, this can avoid that the speed of adjusting the current passing through the power transistor 120 becomes too slow due to a slower voltage transition rate, so that a significant abrupt change of voltage would not be introduced into the output voltage VOUT. This therefore achieves an advantage of stabilizing the level of output voltage VOUT.

Figure 3A:
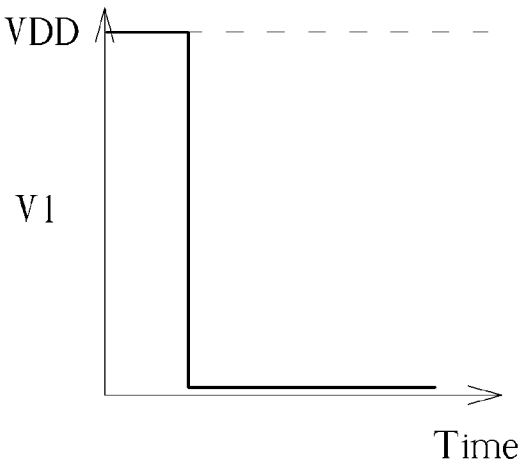
FIGS. 3A-3C are diagrams respectively illustrating different waveforms of the current value of loading current passing through a P-type power transistor in the cases of conventional schemes and the embodiment of the present invention when the loading current changes from a light loading current to a heavy loading current.
Figure 3A:
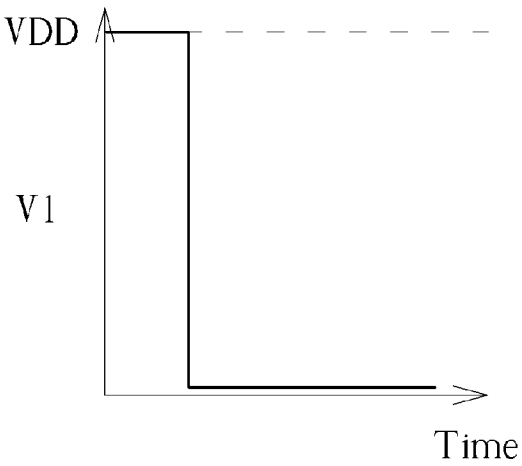
Figure 3A:
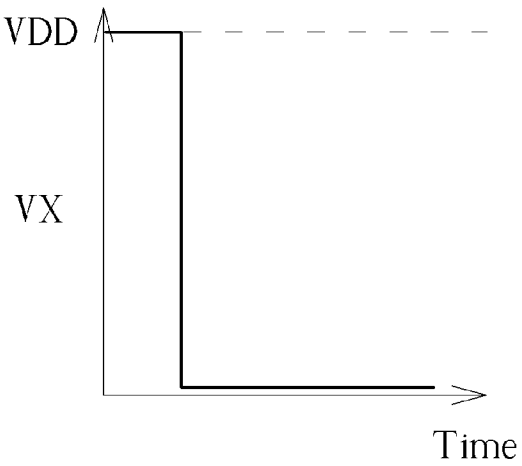
Figure 3B:
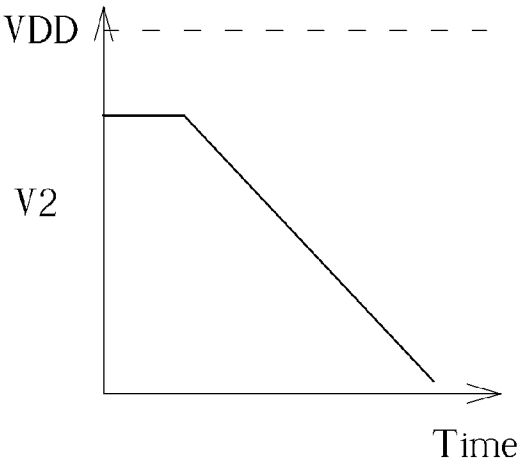
Figure 3B:
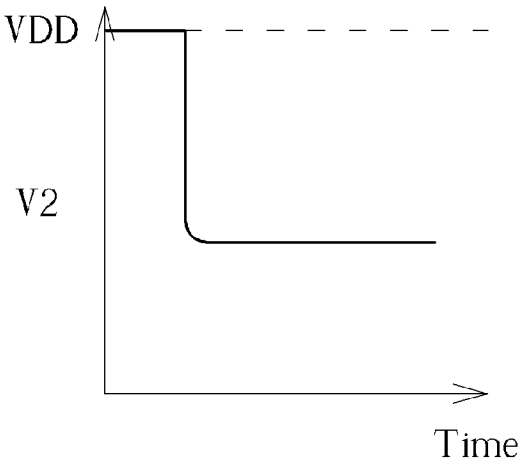
Figure 3C:
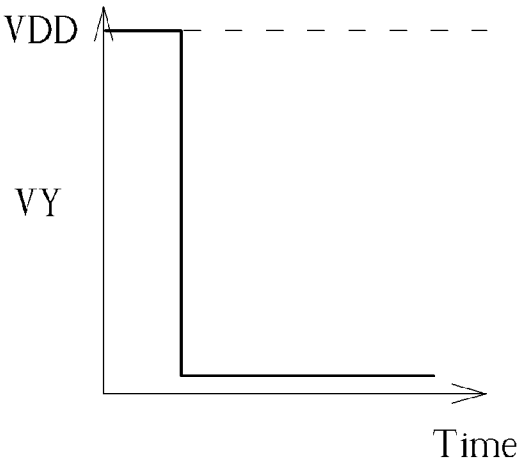

In this embodiment, the power transistor 120 is implemented with (but not limited to) the P-type transistor. When the loading current $I_{load}$ changes, the conductance of the P-type transistor is correspondingly changed. For example, when the loading current $I_{load}$ changes from a light loading current to a heavy loading current, the conductance of the P-type transistor is rapidly increased. In other words, the level at the gate terminal of P-type transistor is reduced from a high voltage level down to a low voltage level. Please refer to FIGS. 3A-3C. FIGS. 3A-3C are diagrams respectively illustrating waveforms of the level at the gate terminal of a power transistor in the cases of conventional schemes and the embodiment of the invention when the loading current changes from a light loading current to a heavy loading current. FIG. 3A and FIG. 3B are different diagrams illustrating waveforms of the level at gate terminal of the power transistor by using different conventional schemes. FIG. 3C is a diagram illustrating the waveform of the level of second voltage signal VY (i.e. the level at gate terminal of power transistor 120) as shown in FIG. 1. As shown in these figures, for the waveforms of the level at gate terminal of power transistor based on one of the different conventional schemes, when the loading current changes from a light loading current to a heavy loading current, the curve V1 of FIG. 3A represents an ideal case of the waveform of the level at gate terminal of power transistor. That is, in the ideal case, the level immediately transits from a high voltage level to a low voltage level. However, the actual waveform of the level at gate terminal of the power transistor is represented by the curve V2 of FIG. 3A. As shown in the curve V2 of FIG. 3A, the level at the gate terminal of power transistor cannot be immediately transited from the high voltage level to the voltage level. It is necessary to waste a time period for gradually reducing the level at the gate terminal to cause the level reach the low voltage level after the time period. In addition, as shown by the curve V2 of FIG. 3A, the level at the gate terminal of power transistor actually corresponds to a high voltage level which is not close to the operation voltage VDD. The difference between the high voltage level shown by curve V2 and the operation voltage VDD is not small.

Additionally, as shown in FIG. 3B, when the loading current changes from a light loading current to a heavy loading current, the curve V1 of FIG. 3B represents an ideal case of the waveform of the level at gate terminal of power transistor. In the ideal case, the level should be immediately transited from the high voltage level to the low voltage level. As shown by the curve V2 of FIG. 3B, the conventional scheme adopted in FIG. 3B causes the level at the gate terminal of power transistor be reduced immediately, but however this conventional scheme cannot reduce and cause the level to reach or approximate the ground level VGND even though a long time period has elapsed. In FIG. 3C, the embodiment of the present invention obtains more advantages. As shown by the curve VY of FIG. 3C, when the loading current changes from a light loading current to a heavy loading current, the level of output voltage VX of the operational amplifier 110 is immediately transited from a high voltage level to a low voltage level. The curve VY indicates that the buffer stage circuit 115 can immediately and rapidly cut down the level VY at gate terminal of power transistor 120 to cause the level VY approximate to the ground level VGND. In addition, as shown by the curves of FIG. 3C, the curve VX indicates that an ideal high voltage level at the output voltage VX of operational amplifier 110 reaches the operation voltage VDD; as shown by the curve VY of FIG. 3C, the curve VY indicates that the level VY at the gate terminal of power transistor 120 of this embodiment can be almost close to the operation voltage VDD.

Figure 4A:
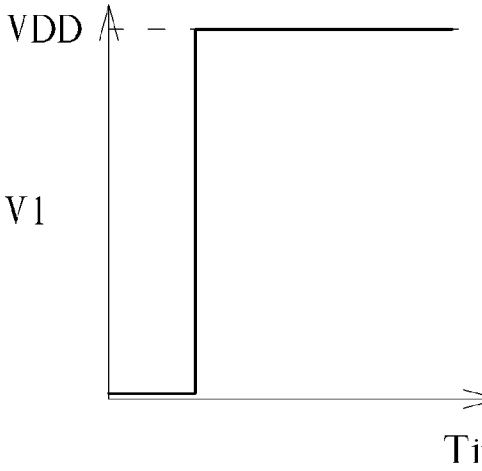
FIGS. 4A-4C are diagrams illustrating different waveforms of the voltage level at the gate terminal in the cases of conventional schemes and the embodiment of the present invention when the loading current of a P-type power transistor changes from a heavy loading current to a light loading current.
Figure 4B:
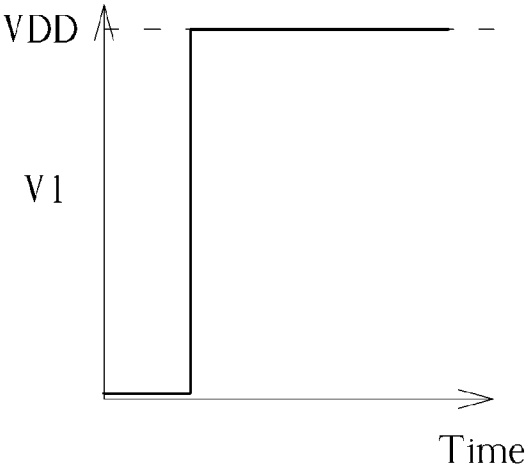
Figure 4B:
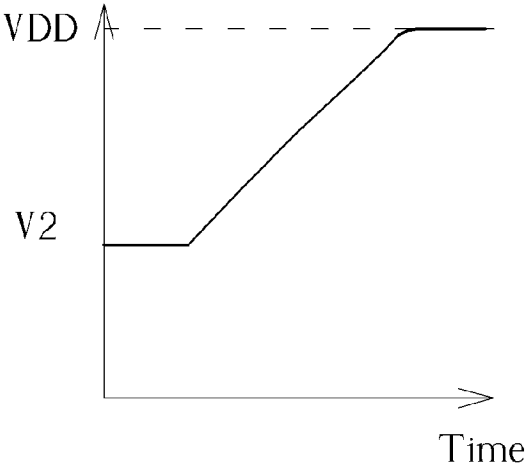
Figure 4C:
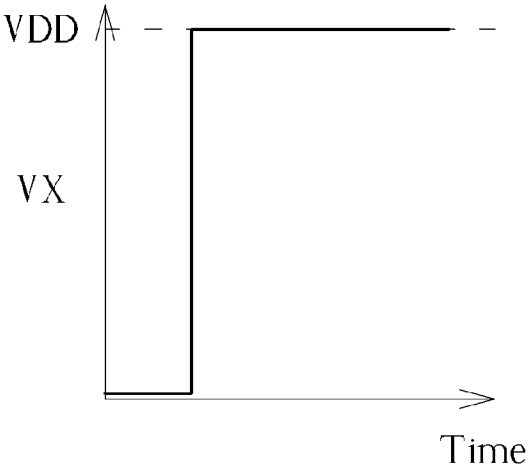
Figure 4C:
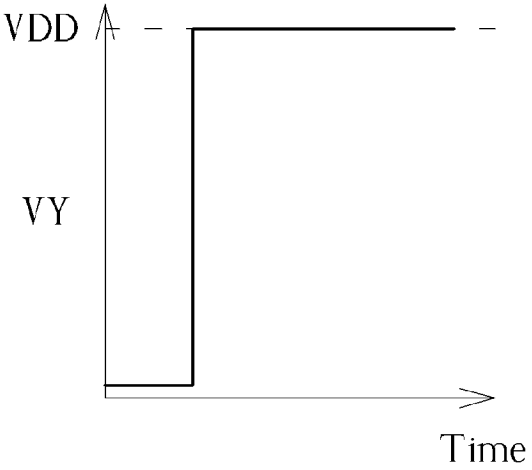
Figure 5:
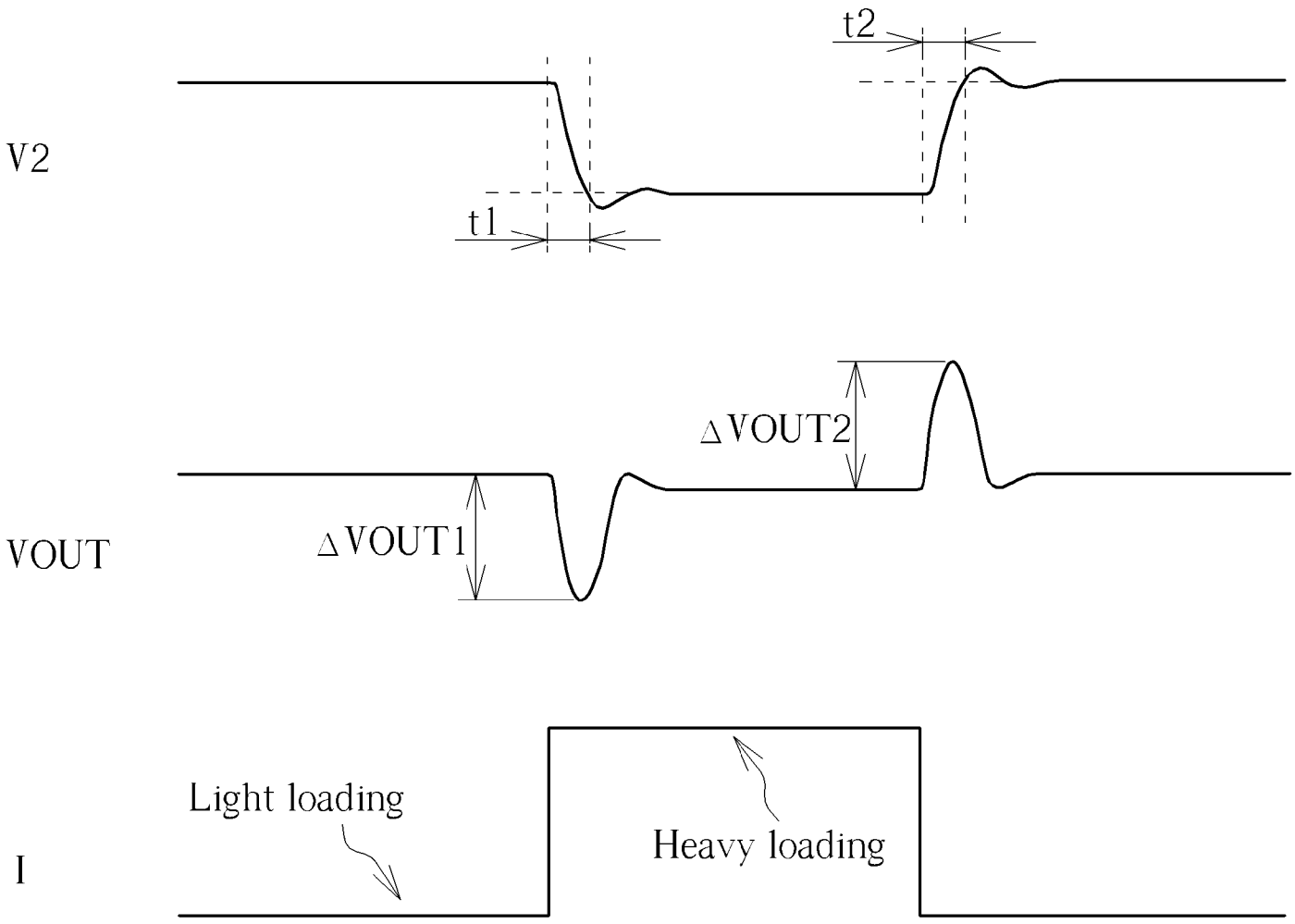
FIG. 5 is a diagram illustrating waveforms of the level at the gate terminal of the conventional power transistor, the output voltage, and the loading current.

Further, when the loading current $I_{load}$ changes from a heavy loading current to a light loading current, the conductance of the P-type transistor would be rapidly decreased. The level at the gate terminal of P-type transistor would be raised from a low voltage level to a high voltage level. Please refer to FIGS. 4A-4C. FIGS. 4A-4C are different diagrams illustrating the waveforms of the level at the gate terminal of a power transistor in the cases of conventional schemes and the embodiment of the invention when the loading current of the power transistor changes from a heavy loading current to a light loading current. FIGS. 4A and 4B are different diagrams illustrating the waveforms of the level at the gate terminal of a power transistor based on two different conventional schemes. FIG. 4C is a diagram illustrating the waveform of the second voltage signal VY (i.e. the level at the gate terminal of power transistor 120) according to the embodiment of FIG. 1. As shown in these figures, for the level at gate terminal of the power transistor based on one of the conventional schemes mentioned above are applied, when the loading current changes from a heavy loading current to a light loading current, an ideal waveform of the level at gate terminal of the power transistor should be shown by the curve V1 of FIG. 4A. A low voltage level should be immediately transited and rapidly raised to a high voltage level. Practically, as shown by the curve V2 of FIG. 4A, one of the conventional schemes may immediately raise the low voltage level at the gate terminal of the power transistor if this conventional scheme is applied. However, this conventional scheme cannot raise and cause the level to reach or approximate to the operation voltage VDD even though a long time period has elapsed. A difference between a final high voltage level and the operation voltage VDD is not small. Additionally, as shown in FIG. 4B, when the loading current changes from a heavy loading current to a light loading current, the ideal waveform of the level at the gate terminal of the power transistor should be indicated by the curve V1 of FIG. 4B. That is, in the ideal case, the low voltage level should be immediately transited and rapidly raised to the high voltage level. However, the practical waveform of the level at the gate terminal of the power transistor is indicated by the curve V2 of FIG. 4B based on the other conventional scheme. The level at the gate terminal of the power transistor cannot be immediately transited and rapidly raised to the high voltage level. It is necessary to waste a time period for gradually raising the voltage level to reach the high voltage level. In addition, the curve V2 of FIG. 4B also indicates that a low voltage level practically corresponding to the level at the gate terminal of the power transistor is not close to the ground level VGND. A difference between this low voltage level and the ground level VGND is not small.

In FIG. 4C, the embodiment of the present invention obtains more advantages. As shown by the curve VY of FIG. 4C, when the loading current changes from a heavy loading current to a light loading current, the level of output voltage VX of the operational amplifier 110 is immediately transited from a low voltage level to a high voltage level. The buffer stage circuit 115 can immediately and rapidly raise the level VY at gate terminal of power transistor 120 to cause the level VY approximate to the operation voltage VDD. In addition, as shown by the curve VX of FIG. 4C, the curve VX indicates that an ideal high voltage level at the output voltage VX of operational amplifier 110 reaches the operation voltage VDD; as shown by the curve VY of FIG. 4C, the curve VY indicates that the level VY at the gate terminal of power transistor 120 of this embodiment can be almost close to the operation voltage VDD.

Further, it should be noted that the implementation of the buffer stage circuit 115 shown in FIG. 2 is merely used as an example and is not intended to be a limitation of the invention. In other embodiments, different types of transistors can be adopted to implement the first switch, current mirror, and the second switch. Thus, all of the modifications of the buffer stage circuit 115 fall within the scope of the invention. In addition, the buffer stage circuit 115 is used for improving the low rate of voltage transition for the level at the gate terminal of a transistor by rapidly raising or rapidly cutting down the level at the gate terminal of the transistor. Any modifications by rapidly raising or rapidly cutting down a level at the gate terminal of a transistor to improve the rate of voltage transition should fall within the scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A low-drop (LDO) regulator apparatus, comprising:

an operational amplifier, for receiving a reference voltage and a feedback voltage to generate a first voltage signal;

a buffer stage circuit, coupled to a power transistor, for buffering the first voltage signal to generate a second voltage signal, the buffer stage circuit comprises:

a first switch, for receiving the first voltage signal to decide whether to enable an operation of a current mirror;

the current mirror, coupled to the first switch, for mirroring and generating the mirrored current according to the first voltage signal; and a second switch, coupled to an output terminal of the current mirror, for providing the second voltage signal to the power transistor to turn off the power transistor; and the power transistor, coupled to the buffer stage circuit, for generating an output voltage according to the second voltage signal, the output voltage being proportional to the feedback voltage;

wherein the buffer stage circuit is arranged to determine whether to mirror and generate a mirrored current according to the first voltage signal, and to generate the second voltage signal for providing the second voltage signal to the power transistor to control the power transistor to switch to an on state or an off state according to the first voltage signal in response to that when the mirrored current is generated; when the second switch is turned on, the current mirror is disabled, and the second switch is arranged to provide the second voltage signal to the power transistor to turn off the power transistor; and, when the second switch is turned off, the current mirror is enabled and is arranged to mirror and generate the mirrored current according to the first voltage signal so as to generate the second voltage signal to turn on the power transistor.

2. The LDO regulator apparatus of claim 1, wherein the second switch is implemented by a native transistor, and the power transistor is a P-type transistor; when the current mirror is not arranged to mirror and generate the mirrored current, the native transistor is conducted so as to provide an operation voltage for the power transistor to turn off the power transistor.

3. The LDO regulator apparatus of claim 1, wherein the current mirror is arranged to amplify a first current to generate the mirrored current that is K2 times than the first current when the first switch receives the first voltage signal and is conducted to cause the first current flow through the first switch.

4. The LDO regulator apparatus of claim 1, wherein the first switch is implemented by a first transistor; the first transistor and the power transistor are designed with a relation of specific channel length/width ratios, and both of the current passing through the first transistor and the current passing through the current mirror are proportional to a current passing through the power transistor.

5. A buffer stage circuit used in a low-drop regulator apparatus, the buffer stage circuit being coupled between an operational amplifier and a power transistor, and the buffer stage circuit comprises:

a first switch, for receiving a first voltage signal generated by the operational amplifier to decide whether to enable an operation of a current mirror;

the current mirror, coupled to the first switch, for mirroring and generating the mirrored current according to the first voltage signal; and a second switch, coupled to an output terminal of the current mirror, for providing a second voltage signal for the power transistor to turn off the power transistor when the mirrored current is not mirrored and generated by the current mirror;

wherein when the second switch is turned on, the current mirror is disabled, and the second switch is arranged to provide the second voltage signal to the power transistor to turn off the power transistor; and, when the second switch is turned off, the current mirror is enabled and is arranged to mirror and generate the mirrored current according to the first voltage signal so as to generate the second voltage signal to turn on the power transistor.

6. The buffer stage circuit of claim 5, wherein the second switch is implemented by a native transistor, and the power transistor is a P-type transistor; and, the native transistor is conducted to provide an operation voltage to the power transistor to turn off the power transistor when the mirrored current is not mirrored and generated by the current mirror.

7. The buffer stage circuit of claim 5, wherein the current mirror is arranged to amplify a first current to generate the mirrored current that is K2 times than the first current when the first switch receives the first voltage signal and is conducted to cause the first current flow through the first switch.

8. The buffer stage circuit of claim 5, wherein the first switch is implemented by a first transistor; the first transistor and the power transistor are designed with a relation of specific channel length/width ratios, and both of the current passing through the first transistor and the current passing through the current mirror are proportional to a current passing through the power transistor.

* * * * *